United States Patent [19]

Mabboux et al.

[11] Patent Number: 4,875,299

[45] Date of Patent: Oct. 24, 1989

[54] SKI BOOT

[75] Inventors: Michel Mabboux, Seynod; Jean-Louis De Marchi, St. Jorioz; Fabrice Legon, Seynod, all of France

[73] Assignee: Salomon S. A., Annecy Cedex, France

[21] Appl. No.: 224,278

[22] Filed: Jul. 26, 1988

Related U.S. Application Data

[63] Continuation of Ser. No. 931,104, Nov. 17, 1986, abandoned.

[30] Foreign Application Priority Data

Nov. 15, 1985 [FR] France ..... 85 16911

[51] Int. Cl.[4] ..... A43B 5/04

[52] U.S. Cl. ..... 36/117; 36/121; 24/585; 292/170; 292/252

[58] Field of Search ..... 36/117–121; 24/580, 585, 617, 194, 523; 292/170, 252

[56] References Cited

U.S. PATENT DOCUMENTS

| | | | |
|---|---|---|---|
| 1,032,889 | 7/1912 | Freund | 292/252 |
| 1,087,193 | 2/1914 | Skinner | 292/170 X |
| 1,257,998 | 3/1918 | Gruber | 292/170 |
| 1,565,212 | 12/1925 | Sillick | 292/170 X |
| 1,571,453 | 2/1926 | Maxon | 292/170 |
| 2,726,889 | 12/1955 | Lawson | 292/170 |
| 2,832,623 | 4/1958 | Golemon | 292/252 X |
| 4,381,613 | 5/1983 | Lederer | 36/121 |
| 4,455,768 | 6/1984 | Salomon | 36/121 |
| 4,577,420 | 3/1986 | Petrini et al. | 36/117 |
| 4,653,205 | 3/1987 | Koch | 36/117 |

FOREIGN PATENT DOCUMENTS

| | | | |
|---|---|---|---|
| 0172159 | 2/1986 | European Pat. Off. | 36/117 |
| 0182778 | 5/1986 | European Pat. Off. | 36/117 |
| 769803 | 3/1957 | United Kingdom | 292/170 |

*Primary Examiner*—James Kee Chi

*Attorney, Agent, or Firm*—Pollock, Vande Sande & Priddy

[57] ABSTRACT

Ski boot with a device for transmitting flexion forces of the boot upper to the shell base, comprising a slide (8) movable in a transverse groove (7) at the lower forward edge of the cuff (5). The slide is adjustable through the intermediary of a push element (10) which causes displacement of a lock (12) in a rotational movement about an axis (30) perpendicular to the direction of displacement of the push element.

32 Claims, 6 Drawing Sheets

FIG.9
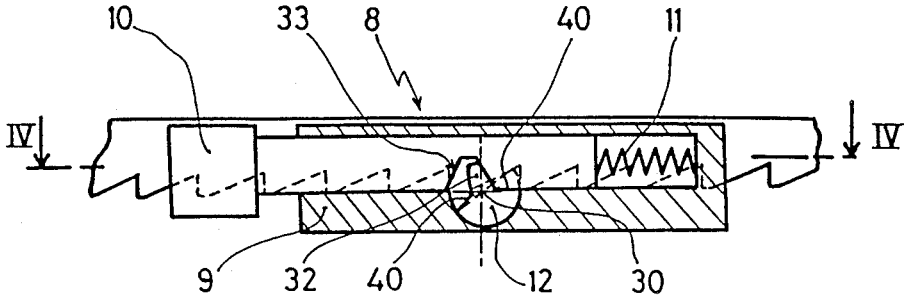
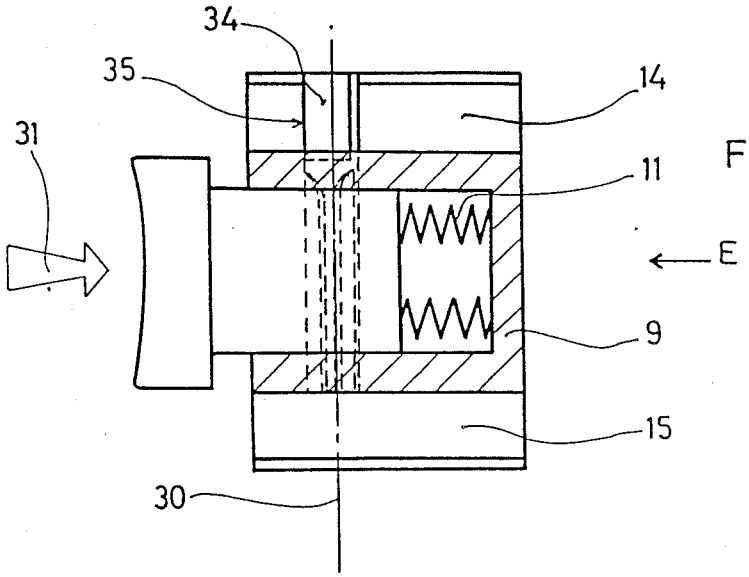
FIG.10
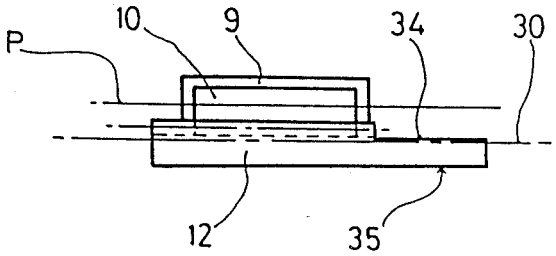
FIG.10a

FIG.11
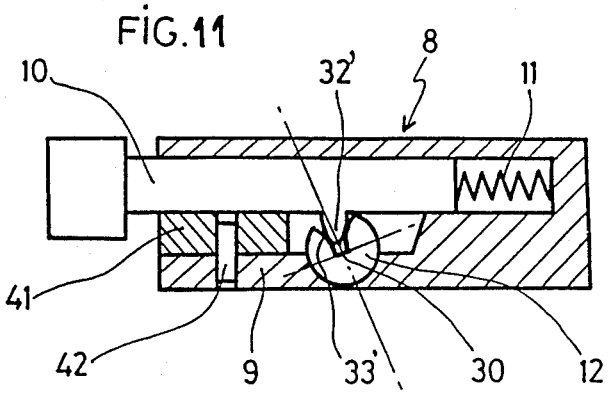
FIG.12
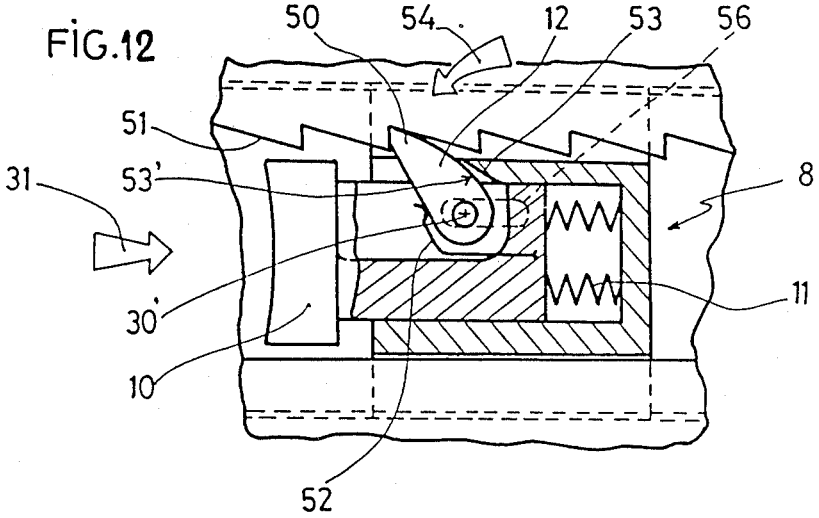
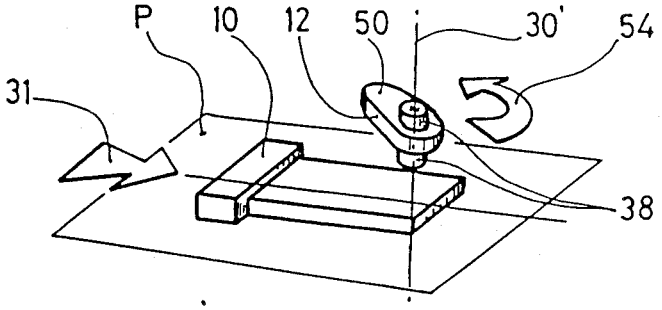
FIG.12a

SKI BOOT

This is a continuation of application Ser. No. 931,104 filed Nov. 17, 1986, now abandoned.

FIELD OF THE INVENTION

The present invention relates to a ski boot provided with a cursor which permits both good locking in position and simplified adjustment.

BACKGROUND OF THE INVENTION

U.S. Pat. Nos. 4,455,768 and 4,577,420 disclose a ski boot constituted by an upper articulated on a shell base, the upper having two parts, namely, a rear part which is articulated on the shell base so as to swing back to permit introduction of the skier's foot into the boot, and a forward part or cuff, also articulated on the shell base and covering the latter particularly in the zone extending from the flexion fold to the instep, the enveloping shape of this lower forward portion of the cuff corresponding to the upper part of the shell base. This lower portion of the cuff comprises an elongated slot extending transversely on at least a portion of the circumference of the lower portion of the zone extending from the flexion fold to the instep.

In this groove may cursor a slide which acts as a movable abutment transmitting forces when the upper of the boot is flexed forwardly.

SUMMARY OF THE INVENTION

The present invention relates to a ski boot having a special slide which is easy to lock into position and to adjust.

According to a first embodiment of the invention, the cursor is constituted by an abutment body comprising at least one rail which makes it solid with one of the edges of the lower part of the cuff, a movable locking means displaceable perpendicularly on said rail so as to enter into a corresponding housing on the edge of said lower portion of the cuff, a push element displaceable perpendicularly on the locking means and connected to the latter by a ramp or the like, such that any movement of the push element causes a displacement of the locking means.

Preferably, the abutment body comprises two guide rails in which slide the two edges of the groove in the lower portion of the cuff, one of the edges of the groove being provided with a series of notches constituting a series of housings for receiving the locking means.

According to other embodiments of the invention, the cursor has different locking kinematics in which, for a rectilinear displacement in the plane of the push element, the locking means describes a circular trajectory whose axis of rotation is either perpendicular or parallel to this plane.

BRIEF DESCRIPTION OF THE DRAWINGS

In order that the invention may be more clearly understood, reference will now be made to the accompanying drawings, wherein several embodiments of the invention will be shown for purposes of illustration, and wherein:

FIG. 9 shows in detail the connection of the push element of the cursor with the locking means.

FIGS. 10 and 10A show schematically the respective displacement directions of the push element and the locking means, FIG. 10A being an elevation view of the cursor according to E in FIG. 10.

FIG. 11 shows a variant of the push element-locking means connection.

FIGS. 12 to 14 show another embodiment of the cursor in which the locking means is displaced in a circular movement in a plane parallel to that of the push element, FIG. 12A showing particularly the direction of the respective displacements of the push element and the locking means with respect to a reference plane.

DETAILED DESCRIPTION OF THE PREFERRED EMBODIMENT

Figure 1:
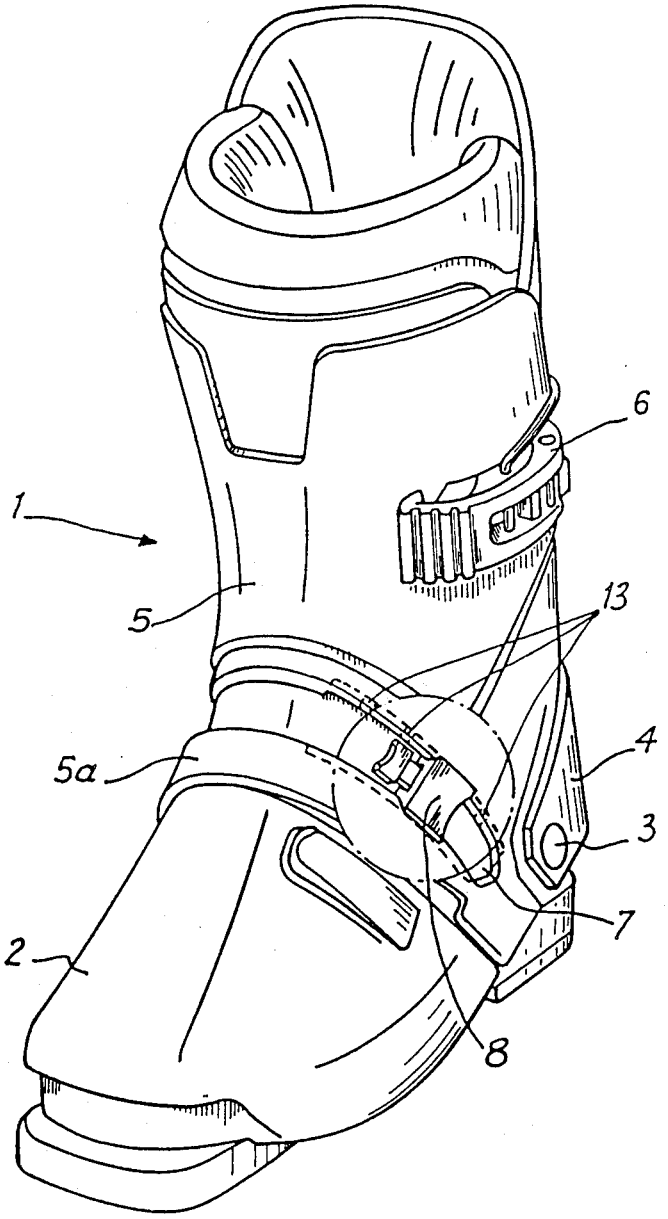
FIG. 1 is a perspective view of a ski boot according to the invention.

FIG. 1 shows a ski boot analogous to the one shown in the above-identified French patents. This boot 1 comprises a shell base 2 on which are articulated, on an axis 3, a rear portion 4 and a cuff 5, these two elements being drawn against one another by a notched system 6 and thus constituting the upper of the boot.

At the lower part of the cuff 5, which covers the upper part of shell base 2, there is a transverse groove 7 in which slides a cursor 8. This cursor has the function of transmitting to the lower portion 5*a* of cuff 5 the flexion movement of said cuff. It will be noted that when cursor 8 is at the bottom of groove 7, the two edges of the groove can more easily approach one another, at the level of the instep, than when cursor 8 is at the center of the groove, right on the instep. Thus, the displacement of cursor 8 makes cuff 5 more or less rigid with respect to forward flexion.

It is obviously very important to the comfort of the skier for changes in the position of the cursor to be made easily, and that, once in place, the cursor cannot easily be displaced in an undesirable manner.

From FIGS. 2 to 6 it will be seen that cursor 8 is constituted by a body 9 in which slides a push element 10 paid out by a spring 11, said push element controlling the displacement of a locking means 12 whose end engages in one or another of a series of housings 13 in one of the edges of groove 7.

Figure 2:
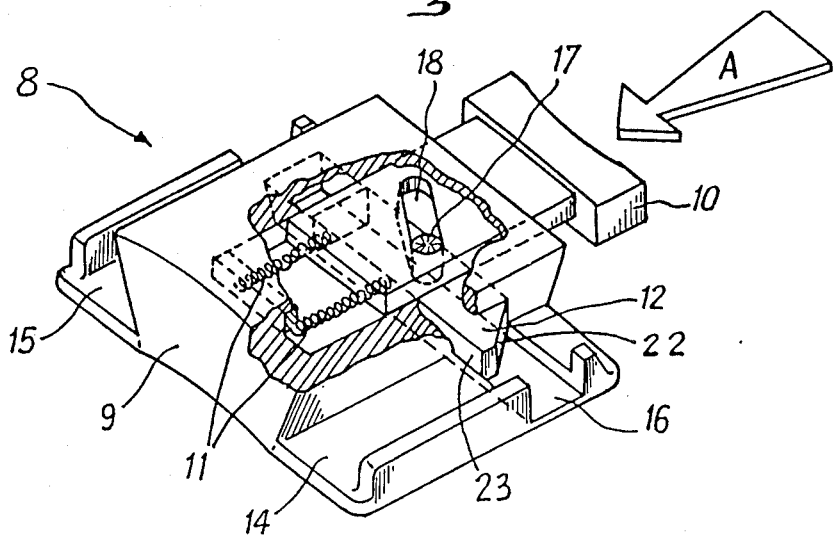
FIG. 2 is a perspective detail view, partly in section, showing a preferred form of cursor.
Figure 3:
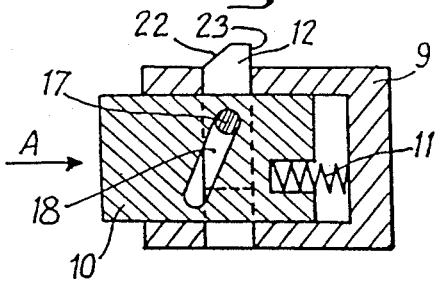
FIG. 3 is a schematic section view of the device of FIG. 2.

As shown in FIG. 2, body 9 of cursor 8 preferably comprises two guide rails 14 and 15 located on each side of said body 9. These rails are hollow and, in the illustrated example, have one wall which is undercut. Inside rails 14 and 15 slide the two edges of groove 7. In the central portion of body 9 there is a locking member 12 which slides in a groove 16 which is perpendicular to rails 14 and 15, i.e., perpendicular to the direction of displacement of cursor 8. This locking member 12 is provided with a lug 17 projecting in a window 18 in push element 10. This window is oriented obliquely to the displacement direction A of push element 10 in cursor body 9, direction A being parallel to rails 14 and 15 and perpendicular to groove 16.

It will be understood that, when push element 10 is actuated in direction A, lug 17 is displaced in window 18, causing locking means 12 to draw back and become disengaged from its housing. Cursor 8 can thus be made to slide in order to bring locking means 12 opposite another housing 13.

Figure 4:
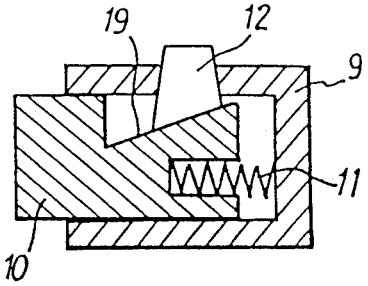
FIGS. 4 to 6 are schematic section views showing three variant embodiments.
Figure 5:
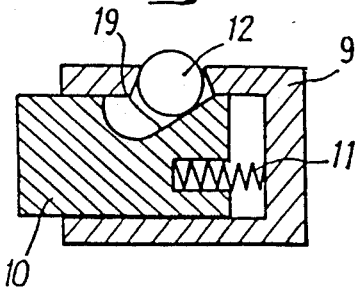
Figure 6:
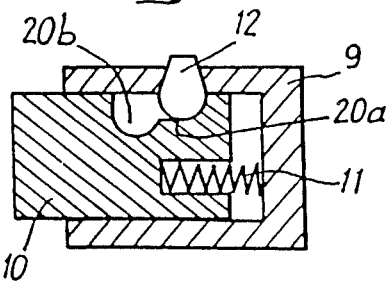
Figure 7:
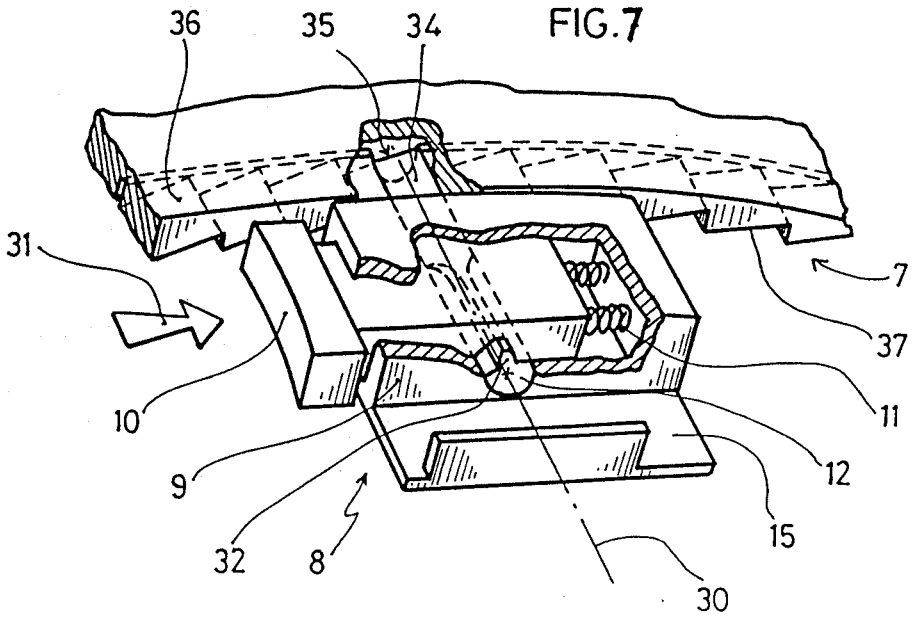
FIG. 7 is an exploded perspective view of an adjustment cursor according to another embodiment of the invention.
Figure 8:
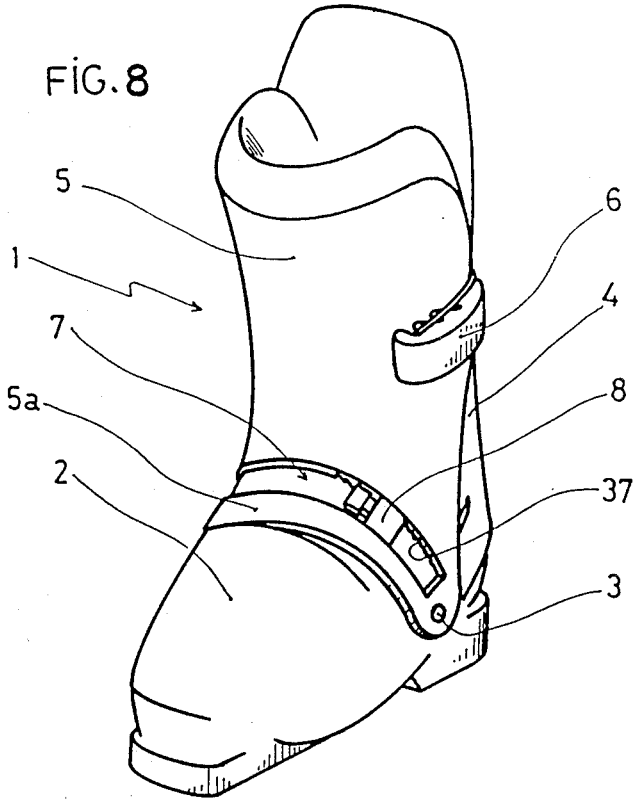
FIG. 8 is a perspective view of a ski boot comprising the flexion adjustment device shown in FIG. 7.

FIGS. 4 to 6 show three variant structures. In the FIG. 4 variant, locking means 12 rests on an inclined plane 19 in push element 10 and descends along such plane when the push element is actuated. In the FIG. 5 variant, locking means 12 is a ball, enabling it to descend more easily along inclined plane 19. In the FIG. 6 variant, locking means 12 is a detent which rests on a surface 20 comprising, (a) a part **20*a* which keeps the detent projecting from body 9, and (b) a part 20*b* which comprises a hollow portion in which the detent is lodged. Obviously, in this case resilient means (not shown) must be provided which cause the detent to return to its housing 20*b*** when the latter faces the detent.

In the example shown in FIG. 1, the lower portion of cuff 5 comprises a groove 7 and cursor body 9 comprises two rails 14 and 15 for the two edges of groove 7. But it will be clear that the cuff could be without a groove, body 9 then comprising only a single rail in which glides the lower edge of cuff 5, slide 7 then being interposed directly between cuff 5 and shell base 2.

In a preferred embodiment, locking means 12 of cursor 8 comprises a beveled lateral face 22 and a right-hand lateral face 23, and said cursor is arranged in a groove 7 such that beveled face 22 of locking means 12 is directed upwardly. Thus, the skier is able, by a simple upward finger push, to regulate the stiffness of the flexion of the boot upper without risk of having the cursor redescend to a "flexible" position for an uneven course, e.g., a field of moguls, due to the fact that locking means 12 permanently cooperates with its right side face 23 in serration 13.

FIGS. 7 to 10 show an embodiment of the locking kinematic of cursor 8 in which locking means 12 pivots about an axis 30 perpendicular to the displacement axis 31 of push element 10, as shown in FIG. 4. In this example, the rotational displacement of locking means 12 is achieved by means of a connection between notch 33 and tooth 32, of a kind analogous to rack gearing. Locking means 12, pivotably mounted in body 9 of cursor 8, comprises a flat portion 34 at its end 35 which is substantially in the shape of a half-cylinder traversing rail 14 coming from cursor body 9. The lateral edge 36 of groove 7, as shown in FIG. 1, is provided with a series of inclined notches 37 whose face is opposite guide rail 14 and hence end 35 of locking means 12. According to the invention, flat portion 34 is angularly oriented in the transverse plane with respect to the position of tooth 32, such that the half-cylinder constituted by end 35 of said locking means disengages from inclined notches 37 when push element 10, displaced in the direction of arrow 31, causes clockwise pivoting of locking means 12.

In maintaining push element 10 against the action of springs 11, cursor 8 can then be made to slide in slot 7 of the boot to the selected adjustment position. It then suffices to loosen push element 10 which, in returning to its original position under the effect of springs 11, carries along tooth 32 of locking means 12, which pivots in a counterclockwise direction, end 35 of locking means 12 then engaging with a corresponding notch 37. It will be noted, in FIG. 9, that the amplitude of the rotary movement of locking means 12 about its axis 31 is advantageously limited by the intermediary of disengagement flats 40 formed on both sides of tooth 32. In this way, when cursor 8 is not mounted in groove 7, push element 10 remains connected to body 9 and locking means 12. As just described, the kinematic connection of push element 10 with locking means 12 is accomplished by means of a tooth 32 and a notch 33, tooth 32 being carried by locking means 12 and notch 33 by push element 10. An arrangement which is the reverse of the one shown in FIG. 11 is, of course, possible, in which case, push element 10 comprises a tooth 32' which cooperates with a notch 33' in the cylinder which constitutes locking means 12. In such a structure, retention of push element 10 with respect to cursor body 9, when the latter is not mounted in groove 7, may be obtained by means of a guide block 41, fixed to body 9 by a keeper pin 42, which obstructs the passage of tooth 32' beyond said locking means.

Preferably, the rotational axis 31 of locking means 12, shown in FIG. 10A, is substantially parallel to transverse plane P of push element 10.

Figure 13:
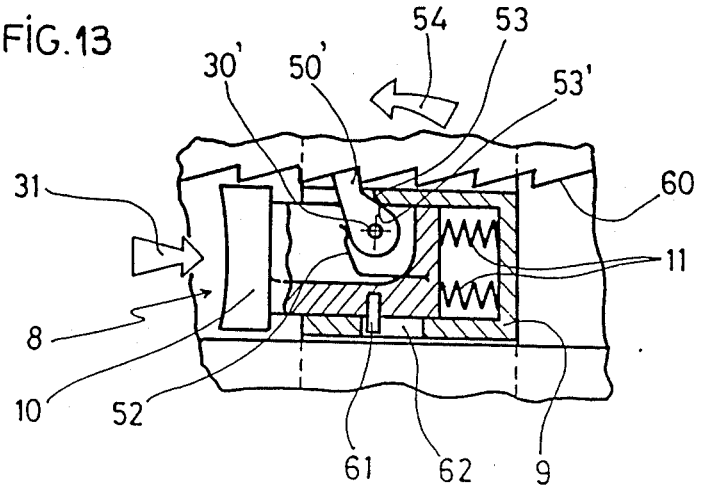

FIGS. 12, 12A and 13 show a further embodiment of cursor 8, in which the rotational axis 30' of locking means 12 is perpendicular to transverse plane P of push element 10, as schematically illustrated in FIG. 12A. Cursor 8 of FIG. 6 comprises a pivoting locking means 12 whose rotational axis 30' is associated with push element 10. Similar to a pawl, the notched end 50 of locking means 12 is caused to engage in notches 51 under the action of a resilient element such as a leaf spring 52 solid with cursor body 9. Notches 51 are formed in the lateral edge portion of groove 7, and are inclined in the same direction as the displacement direction 31 of push element 10. In order to be able to displace cursor 8 in groove 7, push element 10 is acted upon, as in the preceding cases, in the direction of arrow 31, against the action of springs 11. However, in this embodiment, locking means 12 is carried along in the same displacement direction as push element 10 through the intermediary of its rotational axis 30'. An abutment 53 on cursor body 9, laterally of locking means 12 and on the side opposite to the direction of disengagement according to arrow 54 of notched end 50 of notches 51, constitutes the means for rotatably actuating locking means 12, which comes into abutment with the latter through its profiled portion 53'. It goes without saying that, in order to cause locking means 12 to rotate, abutment 53 is always located at a distance from rotational axis 30' of the latter in a direction secanted to displacement direction 31 of push element 10, and preferably substantially perpendicular to the latter. As has been seen in the description of the cursor shown in FIGS. 7 to 11, means for retaining push element 10 with respect to cursor body 9 are provided. Thus, in the present case, the retention means are constituted by a journal 38 embodying rotational axis 30' of locking means 12 and cooperating, at least one of its ends, with an elongated slot 56 in the wall of the cursor in which it slides. This slot 56 extends for a length sufficient to permit displacement of push element 10 in direction 31 to the point of unlocking locking means 12 from slots 51, without interfering with the engagement of catch 50 at the base of said notches.

It will be obvious for FIG. 13 that notches 60 can be inclined in a direction opposite to displacement direction 31 of push element 10 while retaining the structure of a slide comparable to that described with reference to FIGS. 12 and 12A. It suffices to orient the catch end 50' to correspond with notches 60, with the disengagement direction remaining the same. In this example, push element 10 is retained with respect to cursor body 9 by means of a detent 61 sliding in a slot 62.

Figure 14:
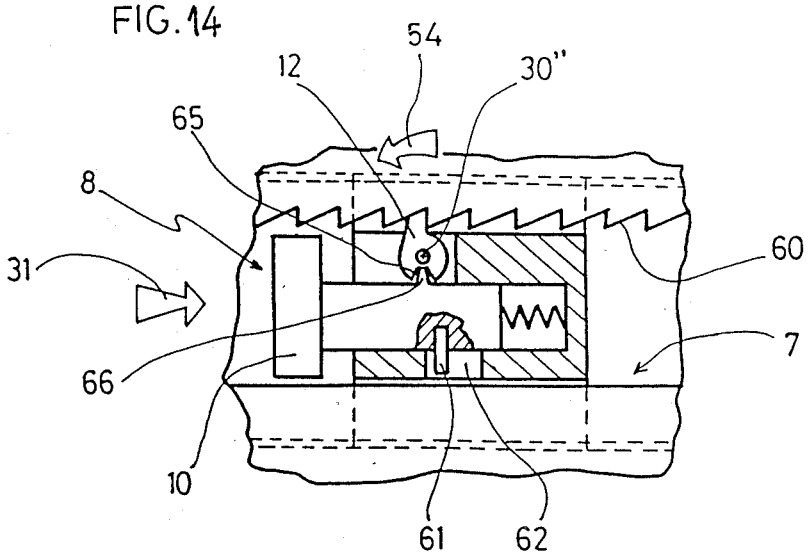

The cursor 8 shown in FIG. 14 differs from those of FIGS. 12 and 13 in that the rotational axis 30" of locking means 12 is carried and fixed on body 9. The transmission of movement of push element 10 on locking means 12, in the direction of arrow 31, is accomplished by means of a tooth 66 and a projection 65 respectively unitary with push element 10 and locking means 12. As in the structure of FIGS. 9 and 11, these transmission means may be reversed.

What is claimed is:

1. Ski boot of the type comprising a shell base on which is articulated an upper which, during forward flexion, contacts said shell base with its front lower edge, said front lower edge comprising a movable abutment for transmission of forces which is displaceable transversely from one side of the front lower edge to at least its middle portion located at the instep, said abutment having the form of a cursor, wherein said cursor is constituted by (a) a body having at least one lateral rail cooperating with a corresponding groove of said front lower edge, and in which a movable locking means moves perpendicularly to said rail in one of corresponding recessed housings provided in the front lower edge; and (b) a push means moving perpendicularly to the movement of said locking means and cooperating with the latter by means of a ramp means so that every displacement of said push element acts on said locking means, said locking means comprising a detent held by elastic means against a surface arranged in said push means.

2. Ski boot according to claim 1, wherein said push means is held up by a spring towards a position maintaining said locking means in one of said recessed housings.

3. Ski boot according to claim 1, wherein said locking means rests against the ramp means arranged in said push means, said ramp means allowing retraction and projection of said locking means from one recessed housing to another along the front lower edge.

4. Ski boot according to claim 1, wherein said detent is displaced in a window in said push means, obliquely to the direction of displacement of said push means.

5. Ski boot according to claim 3, wherein said locking means is a ball moving on said ramp means.

6. Ski boot according to claim 3, wherein said ramp means is an inclined plane.

7. Ski boot according to claim 3, wherein said ramp means is a surface comprising a first portion maintaining said locking means in a position in which it projects outside said body of said cursor, and a second portion allowing said locking means to retract into the interior of said body.

8. Ski boot according to any one of claim 1 to 7, wherein said body of said cursor comprises at least one hollow rail in which the front lower edge of said upper slides.

9. Ski boot according to any one of claims 1 to 7, wherein said cursor slides in a groove in said lower portion of said upper, said groove having two lateral edges, said body of said cursor comprising two hollow rails in which slide lateral edges of said groove.

10. Ski boot according to claim 9, wherein at least one of said edges sliding in one of said hollow rails is provided with a plurality of notches constituting the recessed housings for said locking means.

11. Ski boot of the type comprising a shell base (2) on which is articulated an upper which, during forward flexion, contacts said shell base with its front lower edge, said lower edge comprising a movable abutment for transmission of forces which is displaceable transversely from one side of the front lower edge to at least its central portion located at the instep, said abutment having the form of a cursor, wherein said cursor (8) is constituted by a body (9) in which a push means (10) held up by a spring (11) is arranged for sliding movement in a rectilinear direction, said push means acting on a locking means (12), said locking means comprising a detent held by elastic means against a surface arranged in said push means.

12. Ski boot according to claim 11, wherein said push means (10) causes the displacement of said locking means (12) in a direction perpendicular to its normal displacement (A).

13. Ski boot according to claim 12, wherein said detent (17) is displaced in a window (18) in said element (10), obliquely to the direction of displacement (A) of the latter.

14. Ski boot according to claim 12, wherein said locking means (12) rests against an inclined plane (19) arranged in said push means (10).

15. Ski boot according to claim 14, wherein said locking means (12) is a ball rolling on said inclined plane (19).

16. Ski boot according to claim 12, wherein said surface comprises a first portion (20*a*) maintaining said detent in a position in which it projects outside said body (9) of said slide (8), and a second portion (20*b*) allowing said detent to slide into the interior of said body.

17. Ski boot according to claim 11, wherein said body (9) of said cursor (8) comprises at least one hollow rail (14, 15) in which the lower edge of said upper (5) slides.

18. Ski boot according to claim 11, wherein said cursor (8) slides in a groove (7) in said lower portion of said upper (5), said groove having two lateral edges, said body (9) of said cursor (8) comprising two hollow rails (14, 15) in which slide lateral edges of said groove (7).

19. Ski boot according to claim 17, wherein at least one of said edges sliding in one of said hollow rails is provided with a plurality of notches (13) constituting housings for said locking means (12).

20. Ski boot according to claim 17, wherein said locking means (12) comprises a beleved lateral face (22) facing the upper side of said boot and another lateral face (23) which is straight.

21. Ski boot according to claim 11, wherein said push means (10) causes rotational movement of said locking means (12) about an axis (30, 30', 30") perpendicular to the direction of displacement of said push means.

22. Ski boot according to claim 21, wherein for rectilinear displacement of said push means (10) in a plane P, the axis of rotation (30', 30") of said locking means in perpendicular to said plane.

23. Ski boot according to claim 21, wherein, for rectilinear displacement of said push means (10) in a plane P, the axis of rotation (30) of said locking means is parallel to said plane.

24. Ski boot according to claim 21, wherein said push means (10) and said locking means (12) cooperate through the intermediary of actuating means such as a gearing (32, 32', 66) and serration (33, 33', 65) with which they are respectively provided, said gearing and said serration being oriented parallel to the axis of rotation (30, 30'') of said locking means.

25. Ski boot according to claim 22, wherein said locking means (12) comprises a profile (53') which contacts an abutment (53) of said body (9) when said push means (10) is moved in said direction of displacement (31), the relative position of said abutment with respect to the axis of rotation (30') of said locking means being oriented in a direction secanted with respect to that of said push means.

26. Ski boot according to claim 22, wherein said locking means (12) is fixed to said push means (10) through the intermediary of a journal (38) incorporating the axis of rotation (30').

27. Ski boot according to claim 21, wherein said locking means (12) is carried by the body (9) of said slide (8) through the intermediary of its axis of rotation (30'', 30).

28. Ski boot according to claim 23, wherein said locking means (12) is a cylindrical axle at least one (35) of whose ends extends in one of said rails (14, 15), and comprises a flat portion (34) on the right of its transverse section cooperating with a series of notches (37) on at least one of the lateral edges of said groove (7).

29. Ski boot according to claim 21, wherein said slide (8) is detachable from said boot.

30. Ski boot according to claim 22, wherein said push means (10) is retained by a stop means (38, 61) cooperating in the direction of pull of said spring (11) with an abutment (56, 62) in said body (9) of said slide (8), in order to prevent said slide (8) from separating from said body (9) in unmounted position on said boot.

31. Ski boot according to claim 30, wherein said stop means (38) cooperates with the bottom of an elongated slot (56) of said slide (8).

32. Ski boot according to claim 29, wherein said locking means (12) is provided with a stop means (40) constituted by a flat portion which abuts said push means (10) under the effect of pushing by the latter by its notch (33) against the tooth (32).

* * * * *